US007308729B2

(12) United States Patent
Seasholtz et al.

(10) Patent No.: US 7,308,729 B2
(45) Date of Patent: Dec. 18, 2007

(54) VACUUM NOZZLE HEAD WITH INTEGRAL SQUEEGEE

(75) Inventors: Craig A. Seasholtz, Avis, PA (US); Robert L. Crevling, Jr., Cogan Station, PA (US)

(73) Assignee: Shop Vac Corporation, Williamsport, PA (US)

( * ) Notice: Subject to any disclaimer, the term of this patent is extended or adjusted under 35 U.S.C. 154(b) by 664 days.

(21) Appl. No.: 10/770,908

(22) Filed: Feb. 3, 2004

(65) Prior Publication Data

US 2005/0166361 A1 Aug. 4, 2005

(51) Int. Cl.
*A47L 9/02* (2006.01)

(52) U.S. Cl. ..... 15/415.1; 15/401

(58) Field of Classification Search ..... 15/401, 15/402, 415.1

See application file for complete search history.

(56) References Cited

U.S. PATENT DOCUMENTS

| | | | | |
|---|---|---|---|---|
| 850,909 | A | 4/1907 | Diserens | |
| 954,541 | A | 4/1910 | Raymond et al. | |
| 2,027,793 | A | 1/1936 | Smith | |
| 2,118,070 | A | 5/1938 | Connor | |
| D161,681 | S | 1/1951 | Dreyfuss | |
| 4,475,265 | A * | 10/1984 | Berfield | 15/414 |
| D311,797 | S | 10/1990 | Hult et al. | |
| 4,989,294 | A | 2/1991 | Fischer | |
| 5,184,372 | A * | 2/1993 | Mache | 15/401 |
| 5,280,666 | A | 1/1994 | Wood et al. | |
| 5,419,007 | A | 5/1995 | Hult et al. | |
| D366,739 | S | 1/1996 | von Grolman et al. | |
| 5,485,652 | A * | 1/1996 | Holland | 15/322 |
| D424,766 | S | 5/2000 | Martin | |
| D439,711 | S | 3/2001 | Griffin | |
| 6,279,198 | B1 | 8/2001 | Martin et al. | |
| 6,421,875 | B1 * | 7/2002 | Coombs et al. | 15/420 |
| D463,082 | S | 9/2002 | Harrington | |

FOREIGN PATENT DOCUMENTS

EP 0 151 739 * 8/1985

OTHER PUBLICATIONS

Translation of EP 0 151 739.*

* cited by examiner

*Primary Examiner*—David Redding
(74) *Attorney, Agent, or Firm*—Marshall, Gerstein & Borun LLP

(57) ABSTRACT

An improved vacuum cleaner nozzle is disclosed which includes a squeegee element disposed along the front wall or front lip. The squeegee element acts to push liquid or slurry materials towards the inlet opening as the nozzle head is drawn towards the user in a pulling or retraction motion. The squeegee elements are preferably integrally molded with the nozzle head structure. In different variations, the squeegee elements comprise either a downwardly extending forward lip or a forwardly extending lip.

4 Claims, 6 Drawing Sheets

VACUUM NOZZLE HEAD WITH INTEGRAL SQUEEGEE

TECHNICAL FIELD

An improved vacuum nozzle head for removing water off of a floor or other flat surface is shown and described. More specifically, the improved vacuum nozzle includes an integrated squeegee disposed along the front or leading edge of the vacuum nozzle that picks up or removes liquid materials off of a floor and moves the liquid materials towards the inlet of the nozzle head as the nozzle head is drawn towards the user.

BACKGROUND OF THE RELATED ART

Vacuum nozzle heads or vacuum nozzles for vacuum cleaners are known. Further, so-called squeegee devices for removing liquid materials from windows and floors are also known. U.S. Pat. No. 5,419,007 discloses a snap together wet nozzle device for use with a vacuum cleaner. The nozzle head includes a means for attaching a squeegee device to the rear wall or rear edge of the nozzle head. Similarly, U.S. Pat. No. 6,279,198 discloses a nozzle head wherein a brush or a squeegee may be snapped into a central portion of the nozzle head.

The problem associated with both of these devices is that neither device is particularly efficient at removing liquid from a floor when the nozzle head is drawn backward or toward the user. Essentially, the liquid on the floor is not efficiently directed towards the vacuum inlet and therefore the liquid is not efficiently sucked up off of the floor during a typical retracting stroke whereby the nozzle head is drawn towards the user or rearwardly.

Similarly, an older patent, U.S. Pat. No. 954,541 discloses a scrubbing device whereby squeegee elements, or flexible rubber-type strips are mounted on both the forward and rearward edges of the nozzle. This device is inefficient for a wet vacuum cleaner as one of the squeegee elements always directs liquid away from the vacuum inlet and outside of the area defined by the nozzle opening.

Another problem associated with the above-referenced devices is the requirement that the squeegee element be fabricated separately from the nozzle housing. The squeegee elements are either snap-fitted into place (U.S. Pat. No. 5,419,007) or secured to the nozzle housing with some sort of fastener elements such as screws (U.S. Pat. No. 954,541). However, today's vacuum cleaner nozzle housings are fabricated from injection molded or blow molded plastic. In today's competitive market, manufacturing efficiencies results in lower manufacturing costs and more competitive pricing. Therefore, there is a need for an improved vacuum nozzle housing which has an integrated squeegee device that is molded with the nozzle housing itself.

SUMMARY OF THE DISCLOSURE

In satisfaction of the aforenoted needs, an improved vacuum nozzle is disclosed which comprises an inlet connected to a nozzle housing. The nozzle housing defines an elongated opening defined by a front wall extending substantially perpendicular to the inlet and a rear wall also extending substantially perpendicular to the inlet. Two opposing sidewalls are disposed between and connected to the front and rear walls so that the elongated opening is defined by the front, rear and sidewalls. The front wall is connected to either a downwardly or forwardly extending front lip.

In a refinement, the inlet is connected to the nozzle housing between the front and rear walls.

In another refinement, the front lip and nozzle housing are a one-piece molded structure.

In another refinement, the inlet, nozzle housing and lip are a one-piece molded structure.

In yet another refinement, the nozzle housing, inlet and lip are a unitary injection-molded structure.

An improved method for claiming liquid materials off of a floor or horizontal surface is also disclosed which comprises providing a nozzle housing with either a downwardly or forwardly extending front lip as described above, providing a suction through the inlet and nozzle housing, drawing the vacuum nozzle across an area to be cleaned with the rear wall proceeding prior to the front wall and with the front lip engaging the area to be cleaned, trailing the elongated opening and thereby pushing liquid materials towards the elongated opening where it is drawn upward through the opening and inlet.

BRIEF DESCRIPTION OF THE DRAWINGS

The disclosed vacuum nozzles are described more or less diagrammatically in the accompanying drawings wherein.

The drawings are not necessarily to scale in the embodiments have sometimes been illustrated by phantom lines and fragmentary views. In certain instances, details which are not necessary for an understanding of the disclosed embodiments or which render other details difficult to perceive may have been omitted. It should be understood, of course, that this disclosure is not necessarily limited to the particular embodiments illustrated herein.

DETAILED DESCRIPTION OF THE PRESENTLY PREFERRED EMBODIMENTS

Figure 1:
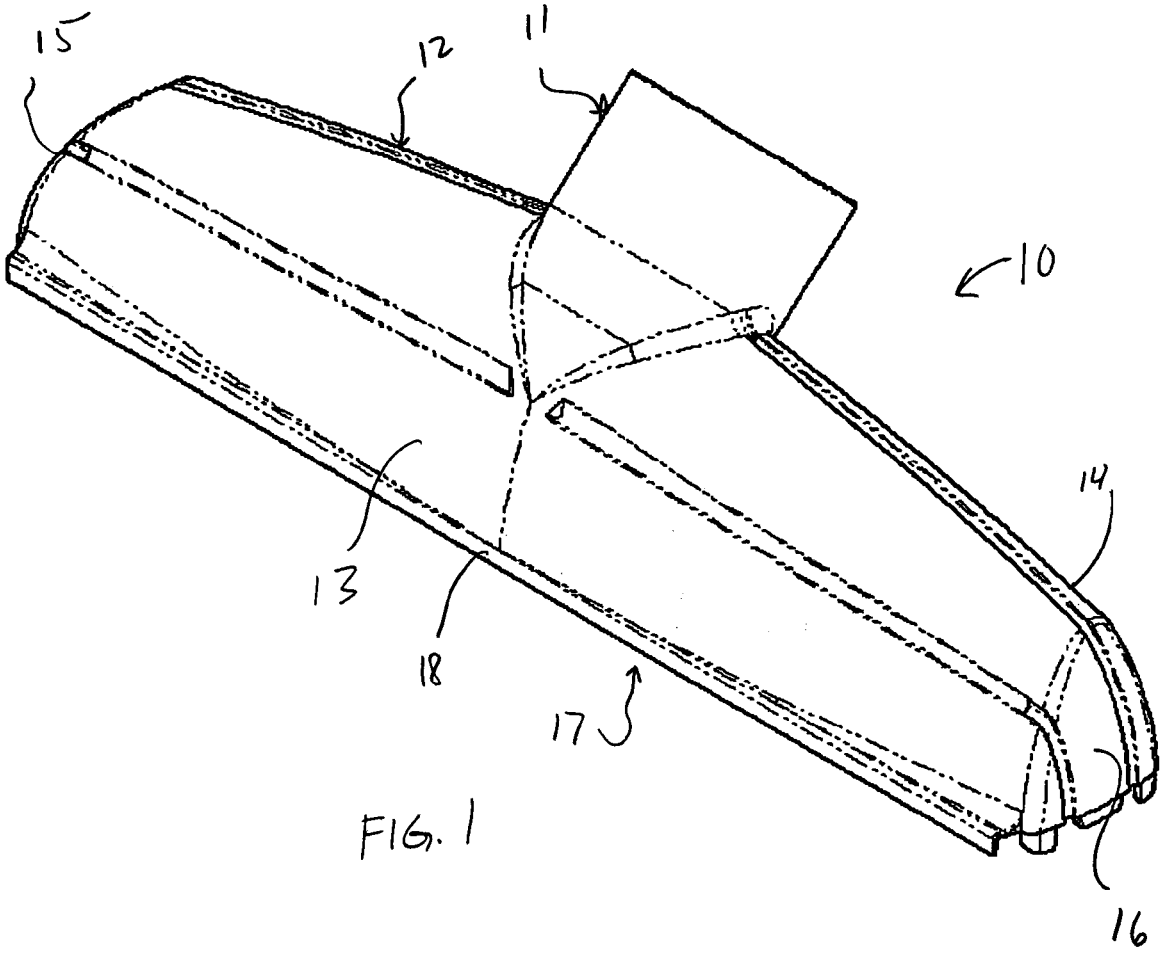
FIG. 1 is a perspective view of an improved vacuum nozzle illustrating an integral front squeegee element.

FIG. 1 illustrates an improved plastic nozzle 10 made in accordance with this disclosure. The nozzle 10 includes an inlet 11 connected to a nozzle housing 12. The nozzle housing 12 comprises a front wall 13, a rear wall 14 (see also FIG. 3) and opposing sidewalls 15, 16. The walls 13-16 define an elongated inlet opening 17. The front wall 13 of the housing 12 features a downwardly extending front lip 18.

Figure 2:
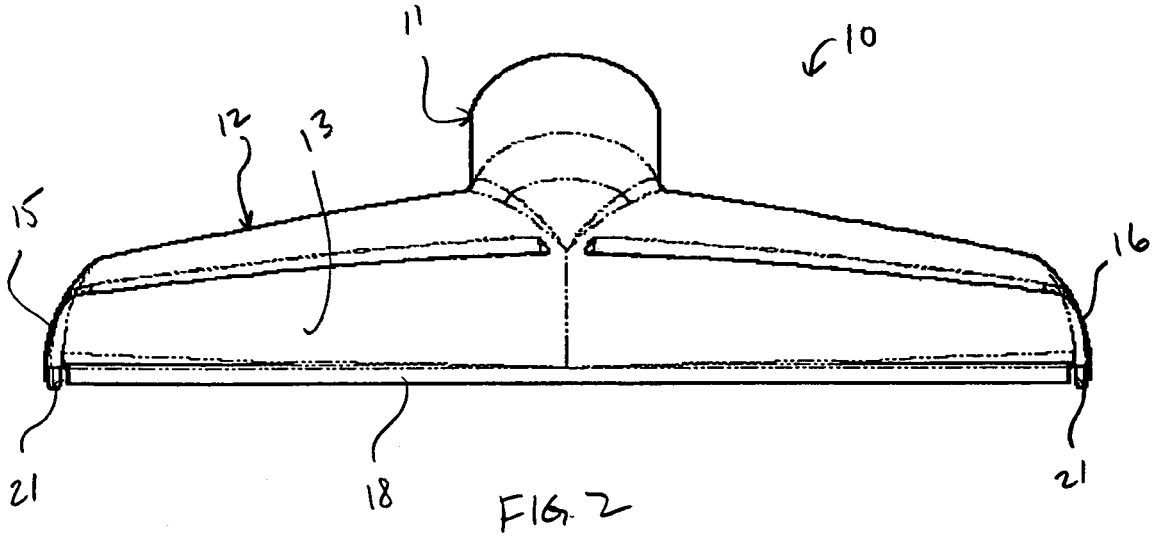
FIG. 2 is a front plan view of the vacuum nozzle shown in FIG. 1.
Figure 3:
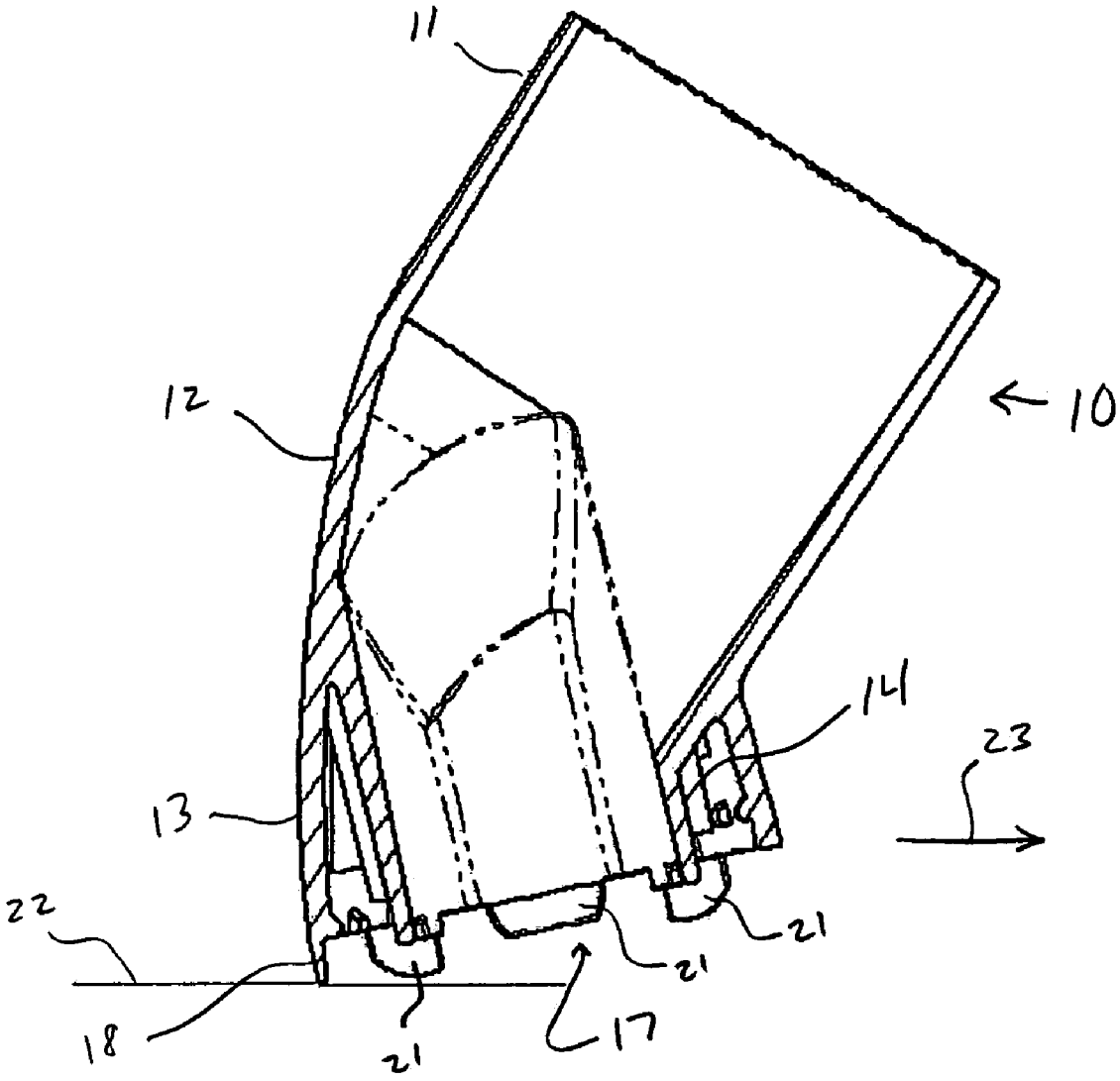
FIG. 3 is a side sectional view of the vacuum nozzle shown in FIGS. 1 and 2 illustrated engagement of the front squeegee with a floor or horizontal surface.

As shown in FIGS. 2 and 3, the sidewalls 15, 16 may include a plurality of downwardly extending pegs shown at 21 which may receive soft rubber or otherwise pliant footings (not shown) which can be used to effectuate a seal between the nozzle housing and the floor 22 (see FIG. 3). As shown in FIG. 3, the downwardly extending lip 18 serves as a squeegee when the nozzle 10 is drawn rearward or towards the user or in the direction of the arrow 23. The lip 18 engages the floor or horizontal surface 22 which then pushes liquid or slurry material towards the elongated opening 17 where it is drawn upward through the vacuum inlet 11. As shown in FIGS. 1-3, the squeegee element 18 is integrally formed with the housing 12 and inlet 11. That is, the entire structure shown in FIGS. 1-3 may be molded using a single mold, preferably by injection molding.

Figure 4:
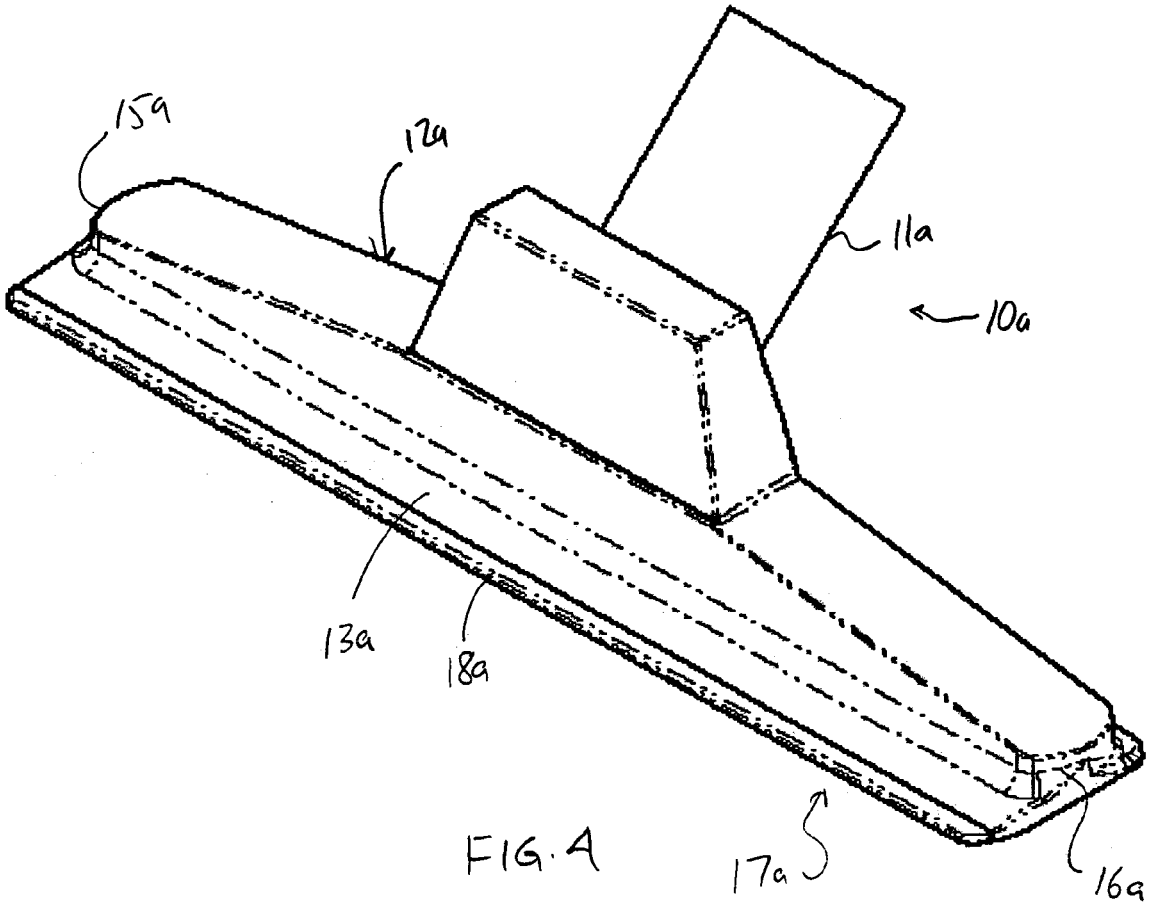
FIG. 4 is a perspective view of an alternative vacuum nozzle made in accordance with this disclosure.
Figure 5:
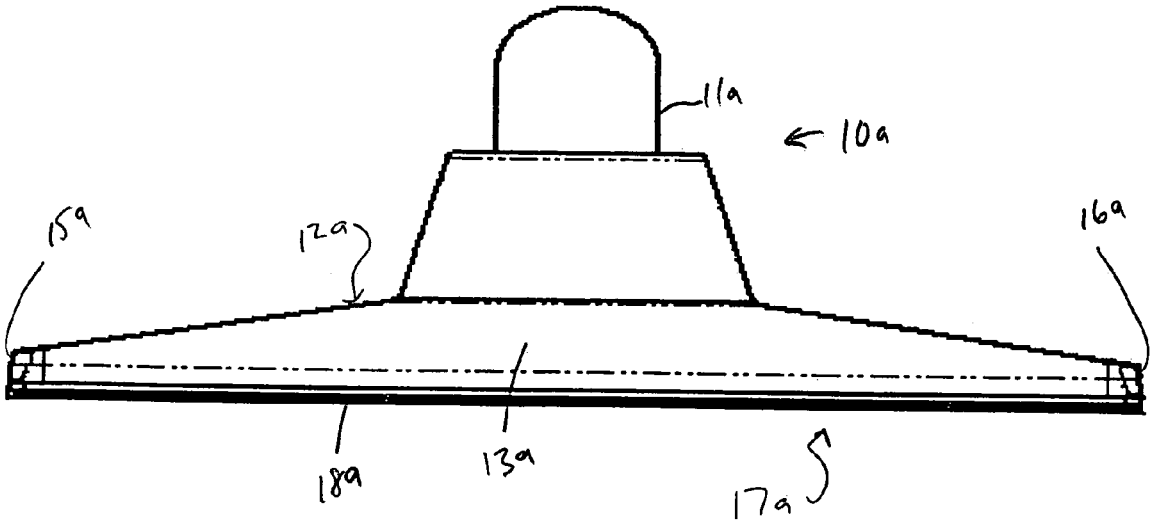
FIG. 5 is a front plan view of the vacuum nozzle shown in FIG. 4.
Figure 6:
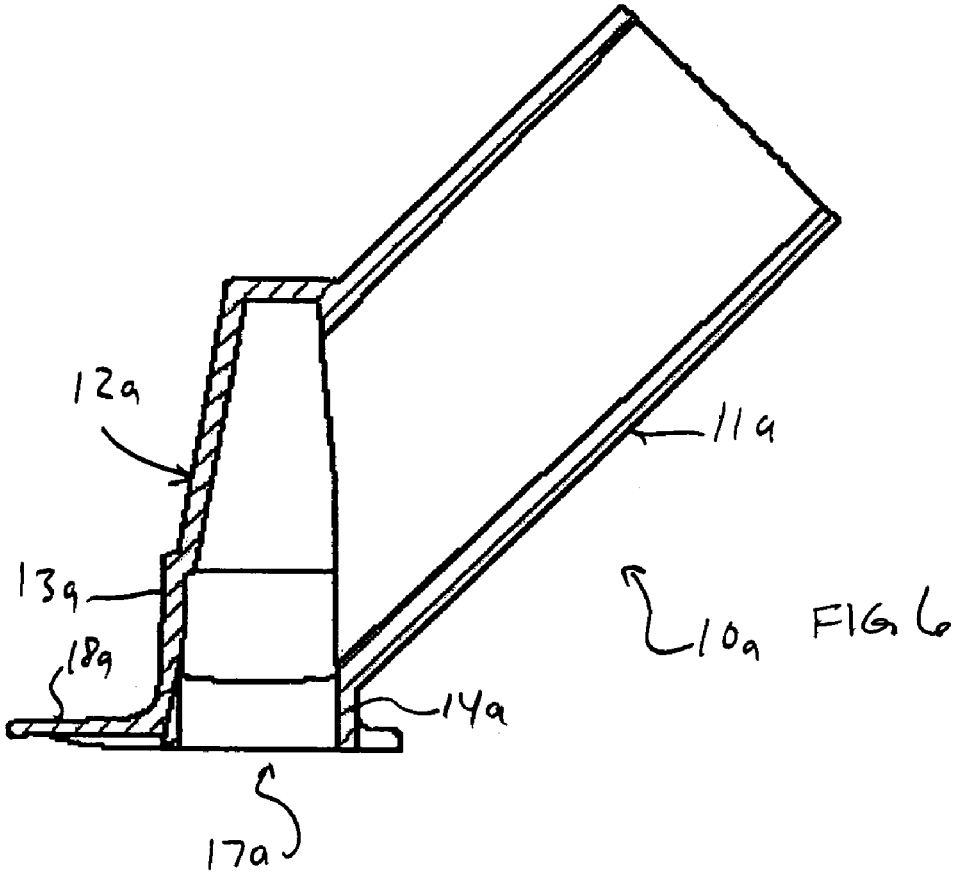
FIG. 6 is a side sectional view of the vacuum nozzle shown in FIGS. 4 and 5.
Figure 7:
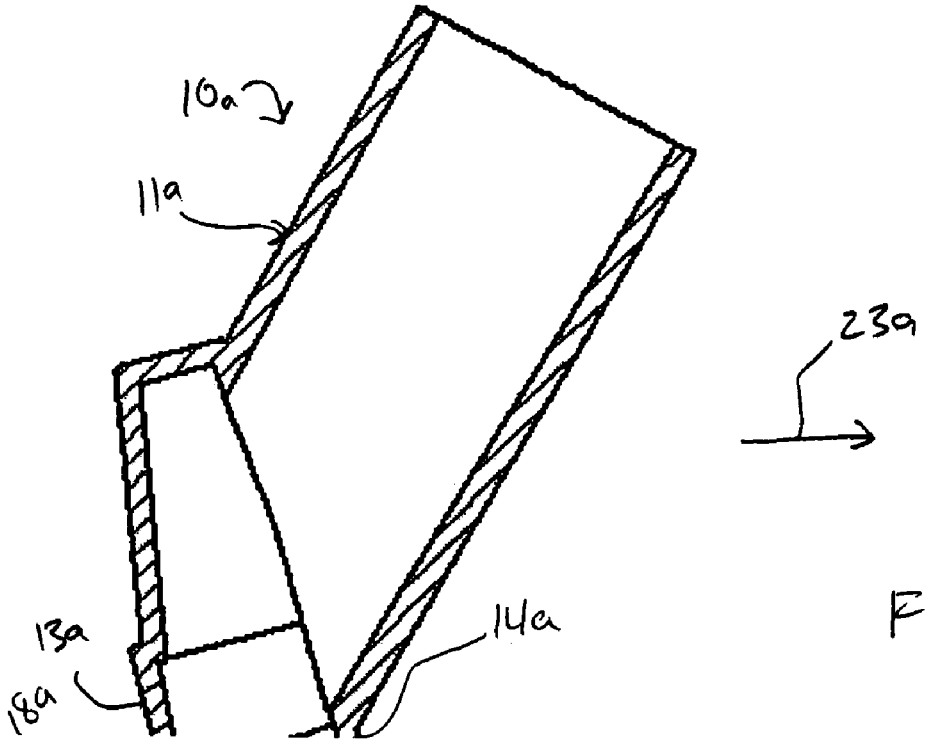
FIG. 7 is another side sectional view of the vacuum nozzles shown in FIGS. 4-6 illustrating engagement of the front squeegee element with the floor or horizontal surface.

Turning to FIGS. 4-7, an alternative embodiment is disclosed wherein the nozzle 10*a* also includes an inlet 11*a* integrally connected to a housing 12*a*. The housing 12*a* also includes a front wall 13*a*, a rear wall 14*a* and a pair of opposing sidewalls 15*a*, 16*a* extending therebetween, all of the walls 13*a*, 16*a* defining an elongated opening 17*a*. A key difference between the nozzle 10*a* as shown in FIGS. 4-7 and the nozzle 10 as shown in FIGS. 1-3 is that the lip 18*a* connected to the front wall 13*a* extends forwardly or relatively horizontally as best seen in FIGS. 4 and 6-7 as opposed to downwardly like the lip 18 as shown in FIGS. 1-3. However, again, the lip 18*a* effectively serves as a squeegee as shown in FIG. 7 when the nozzle 12*a* is tilted in a forwardly direction thereby resulting in the lip 18*a* engaging the floor surface 22*a*. When the nozzle 10*a* is drawn rearwardly, or in the direction shown by the arrow 23*a*, the squeegee lip 18*a* will push liquid and slurry towards the elongated opening 17*a* where it can be sucked up through the inlet 11*a* in a manner similar to that described above with respect to FIGS. 1-3.

The integrally formed squeegees 18, 18*a* as described herein can be easily manufactured with the nozzle 10, 10*a* as separate attachment of these structures is not necessary. The nozzles 10, 10*a* are preferably manufactured by an injection molding process. Preferred polymer materials for such a process include high density polyethylenes, high density polypropylenes, polyvinylchlorides, polyisocyanurates and other suitable polymeric materials. The nozzles 10, 10*a* can be provided as primary nozzles or secondary nozzles for wet vacuum cleaners and wet-dry vacuum cleaners.

One preferred material of construction for the nozzles 10, 10*a* is polypropylene, but certain polyethylenes can be used as well. Other suitable materials include polyvinylchloride, polyethyleneterepthalate, polycarbonate and mixtures thereof. Also, the nozzles 10, 10*a* may be equipped with pliant pads as discussed above which would be separately molded from a softer material, such as a thermal plastic elastomer (TPE). Many TPEs are available and known to those skilled in the art.

While only certain embodiments have been set forth, alternative embodiments and various modifications will be apparent from the above-description to those skilled in the art. These and other alternatives are considered equivalents and within the spirit and scope of this disclosure.

What is claimed is:

1. A vacuum nozzle comprising:

a nozzle housing;

an inlet to the nozzle housing;

a rear wall;

two opposing sidewalls that are connected to the rear wall;

a front wall that is disposed between and connected to the sidewalls;

a generally-horizontally disposed squeegee section that is integral with and extends from a forwardmost edge of the front wall; and a downwardly-extending central section that is disposed at a forward edge of the squeegee section and engages the floor when the nozzle is drawn rearward.

2. The vacuum nozzle of claim 1 wherein the inlet is connected to the nozzle housing between the front and rear walls.

3. The vacuum nozzle of claim 1, wherein the squeegee section and the nozzle housing are both parts of a one-piece molded structure.

4. The vacuum nozzle of claim 1 wherein the inlet, the nozzle housing, and the squeegee section are all parts of a one-piece molded structure.

* * * * *